United States Patent [19]

Cooper

[11] Patent Number: 4,556,821

[45] Date of Patent: Dec. 3, 1985

[54] COLOR IMAGE DISPLAY SYSTEM HAVING AN IMPROVED EXTERNAL MAGNETIC SHIELD

[75] Inventor: John C. Cooper, Lititz, Pa.

[73] Assignee: RCA Corporation, Princeton, N.J.

[21] Appl. No.: 590,036

[22] Filed: Mar. 15, 1984

[51] Int. Cl.[4] ..... H01J 1/52

[52] U.S. Cl. ..... 315/8; 315/85; 313/160; 358/245

[58] Field of Search ..... 315/8, 85; 358/245; 313/160

[56] References Cited

U.S. PATENT DOCUMENTS

| | | | |
|---|---|---|---|
| 1,956,943 | 5/1934 | Campbell | 250/27.5 |
| 2,047,020 | 7/1936 | Flaherty | 250/27.5 |
| 2,114,612 | 4/1938 | Schlesinger | 250/27.5 |
| 2,292,161 | 8/1942 | Roosenstein | 250/27 |
| 2,343,630 | 3/1944 | Atwood | 315/85 |
| 2,721,995 | 10/1955 | Friend | 340/367 |
| 2,890,362 | 6/1959 | Francken | 313/85 |
| 2,907,914 | 10/1959 | Brownell | 315/8 |
| 3,018,401 | 1/1962 | Stanley | 313/85 |
| 3,240,985 | 3/1966 | Ammerman et al. | 315/8 |
| 3,324,343 | 6/1967 | Norley | 315/8 |
| 3,376,451 | 4/1968 | Mears | 315/8 |
| 3,404,227 | 10/1968 | Alcala et al. | 178/7.8 |
| 3,417,201 | 12/1968 | Joseph et al. | 178/7.82 |
| 3,422,220 | 1/1969 | Bathelt et al. | 178/7.82 |
| 3,431,454 | 3/1969 | Sanders | 315/8 |
| 3,443,138 | 5/1969 | Schwartz | 313/64 |
| 3,564,392 | 2/1971 | Uetz | 315/8 |
| 3,576,395 | 4/1971 | Arrington et al. | 178/7.82 |
| 3,614,519 | 10/1971 | Figlewicz | 315/8 |
| 3,867,668 | 2/1975 | Shrader | 315/8 |
| 3,887,766 | 6/1975 | Caswell | 178/7.82 |
| 3,952,152 | 4/1976 | Lill et al. | 178/7.82 |
| 4,000,432 | 12/1976 | Coon et al. | 313/242 |
| 4,019,085 | 4/1977 | Sakata | 313/402 |
| 4,198,587 | 4/1980 | Verhoeven et al. | 313/402 |
| 4,218,712 | 8/1980 | Clymer et al. | 358/229 |
| 4,243,913 | 1/1981 | Nero | 315/8 |
| 4,274,031 | 6/1981 | Saito | 313/407 |
| 4,385,256 | 5/1983 | Tokita et al. | 313/407 |

FOREIGN PATENT DOCUMENTS

| | | |
|---|---|---|
| 54-25157 | 2/1979 | Japan . |
| 54-110782 | 8/1979 | Japan . |
| 378681 | 8/1932 | United Kingdom . |

OTHER PUBLICATIONS

Polyresearch Service, Dutch Patent Application No. 69.05722 to Sony Corporation, OPI Oct. 16, 1969, priority date Apr. 14, 1968, Japan (24594-68).

*Primary Examiner*—Harold Dixon

*Attorney, Agent, or Firm*—Eugene M. Whitacre; Dennis H. Irlbeck; Vincent J. Coughlin, Jr.

[57] ABSTRACT

A color image display system includes a shadow mask type cathode-ray tube having a longitudinal axis, the tube including a panel, a funnel and a neck with a deflection yoke assembly encircling adjoining segments of the neck and funnel. A plurality of neck components are disposed around the neck of the tube. In one embodiment, an external magnetic shield is disposed along opposite sides of the funnel and neck of the tube. The shield extends across the longitudinal axis behind the neck for shunting magnetic fields from the tube while providing access to the deflection yoke assembly and the neck components. In a second embodiment, a second external magnetic shield is disposed orthogonal to the aforementioned external shield and spaced therefrom.

10 Claims, 5 Drawing Figures

COLOR IMAGE DISPLAY SYSTEM HAVING AN IMPROVED EXTERNAL MAGNETIC SHIELD

BACKGROUND OF THE INVENTION

The invention relates generally to color image display systems, and particularly to a system associating a deflection yoke assembly with a shadow mask type cathode-ray tube incorporating external shield means disposed along opposite sides of the tube and across the longitudinal axis behind the tube, while providing access to the deflection yoke assembly and the neck components.

In a color image display system having a shadow mask type cathode-ray tube, a plurality of convergent electron beams are projected through a multi-apertured color selection shadow mask to a mosaic phosphor screen. The beam paths are such that each beam impinges upon and excites only one color of the color-emitting phosphor of the screen.

When a shadow mask type cathode-ray tube is operated, external magnetic fields, such as the earth's field or fields created by the electronic components of the image display system, will cause electron beam path distortion and thereby affect the register of the electron beams with the phosphor elements of the screen. The exact misregister caused by the earth's magnetic field varies substantially in widely separated geographic locations and depends upon the orientation of the tube in the magnetic field and the size of the tube. For example, in computer display terminals and home television receivers, the tube is generally oriented so that the longitudinal axis of the tube is horizontal; however, in some video game applications, the tube may be placed in a table so that the longitudinal axis is directed upward. In the United States, the average intensity of the horizontal component of the earth's magnetic field is about 20,000 gamma, whereas the average intensity of the vertical component is about 47,000 gamma. Thus, in the United States, a shadow mask type cathode-ray tube, which is oriented so that the tube axis is aligned parallel to the vertical component of the earth's magnetic field, experiences greater misregister of the electron beams than if the same tube were operated with the tube axis parallel to the horizontal component of the earth's magnetic field. Larger diameter tubes show a greater effect because of the longer beam paths. Tube operation in different parts of the world also must take into consideration the relative strength of the two components of the earth's magnetic field at the geographical point of operation. By way of example, the horizontal component of the earth's magnetic field intensity in Singapore is about 40,000 gamma or twice that of the United States. The use of magnetic shielding to minimize these magnetic effects is well known; however, a satisfactory solution to the problem has not yet been achieved.

Conventional magnetic shielding is shown in U.S. Pat. No. 3,867,668, issued to Shrader on Feb. 18, 1975. In the Shrader patent, a two portion external shield extends partially around the funnel of the tube and overlies an opening in the internal shield. The structure of the Shrader patent does not provide shunting of the magnetic field component directed parallel to the longitudinal axis of the tube. The use of fully enclosing external shielding to eliminate these magnetic effects is not feasible. To be effective, such a shield would have to project well beyond the front of the tube to prevent the field from entering through the faceplate of the tube.

Furthermore, in a shield of any practical size, its effect in distorting and concentrating the earth's field at particular points might be more serious than the reduction in average field strength. Additionally, initial yoke assembly adjustments are made with the external shielding removed from the tube. The installation of the external shielding frequently causes changes in the adjustment and operation of the tube. Fully enclosed external shielding therefore requires openings or other means which provide access to readjust the yoke assembly and neck components. Such fully enclosed shields, with accurately located openings or access means, are costly and impractical for all but the most demanding applications. An example of a "fully enclosed" tube may be found, for example, in U.S. Pat. No. 3,404,227, issued to Alcala et al. on Oct. 1, 1968. In the Alcala et al. patent, an aluminum housing, which encircles the funnel and a portion of the neck of the tube, is sprayed with a magnetic shielding material in the funnel portion of the housing. A cap or end cover encloses the base of the tube; however, the magnetic shielding structure does not extend behind the neck of the tube and across the tube axis and, therefore, does not shunt the component of the earth's field parallel to the longitudinal axis of the tube. Another example of a "fully enclosed" tube in which a magnetic shield encases all the cathode-ray tube components and the tube itself is found in U.S. Pat. No. 3,887,766, issued to Caswell on June 3, 1975. The Caswell shielding structure, comprising a double walled cylindrical housing, which extends beyond the neck of the tube, is a complex structure that does not provide ready access to the deflection assembly and neck components. Such a structure is expensive to produce and makes it difficult to adjust the focus coil and deflection yoke when the shielding structure encloses the tube, since the outer shield does not provide access to the coil or yoke.

SUMMARY OF THE INVENTION

A color image display system includes a shadow mask type cathode-ray tube having a longitudinal axis, said tube includes a panel, a funnel and a neck with a deflection yoke assembly encircling adjoining segments of the neck and funnel. A plurality of neck components are disposed around the neck. External magnetic shield means are disposed along opposite sides of the funnel and the neck and extend across the longitudinal axis behind the neck for shunting magnetic fields from the tube while providing access to the deflection yoke assembly and the neck components.

DETAILED DESCRIPTION OF THE PREFERRED EMBODIMENTS

Figure 1:
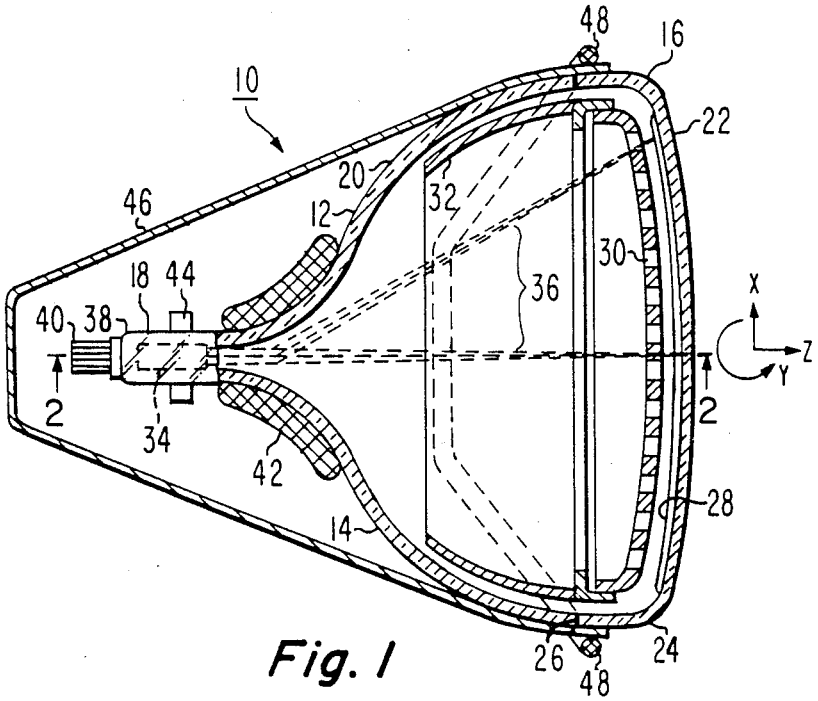
FIG. 1 is an axial view in horizontal section of a color image display system embodying the present invention which is disposed along the major axis of a shadow mask type cathode-ray tube.

FIG. 1 provides an axial view of a shadow mask type cathode-ray tube/deflection yoke assembly combination of a color image display system 10 embodying the present invention. A shadow mask type cathode-ray tube 12 includes an evacuated envelope 14 having a substantially rectangular faceplate panel portion 16 and a cylindrical neck portion 18 connected by a rectangular funnel portion 20. The panel 16 comprises a viewing faceplate 22 and a peripheral flange or sidewall 24 which is sealed to the funnel 14 by a suitable glass frit 26. The faceplate panel 16 has a major axis (X) and a minor axis (Y). A mosaic three-color phosphor screen 28, which may be backed by a reflective metal layer (not shown) of aluminum, is supported on the interior surface of the faceplate 22. The screen 28 may be either a line screen or a dot screen. A multiapertured color selection electrode or shadow mask frame assembly 30 is removably mounted, by a conventional means, in predetermined spaced relation to the screen 28. An internal magnetic shield 32, interconnected to the mask-frame assembly 30, extends into the interior of the funnel portion 20 of the envelope 14. An inline electron gun 34, shown schematically by dashed lines in FIG. 1, is centrally mounted along the longitudinal tube axis (Z) within the neck portion 18 to generate and direct three electron beams 36 along spaced, coplanar convergent beam paths through the mask-frame assembly 30 to the screen 28. The end of the neck portion 18 is closed by a stem 38 having terminal pins or stem leads on which the electron gun 34 is mounted and through which electrical connections are made to the various elements of the electron gun 34. A base 40 is fitted to the tube 12 to separate and support the external portions of the stem leads.

An external magnetic deflection yoke assembly 42 encircles adjoining segments of the neck portion 18 and the funnel portion 20 of the envelope 14. The yoke assembly 42 subjects the three beams 36 to vertical and horizontal deflection fields to scan the beams horizontally and vertically in the directions of the major and minor axes, respectively, in a rectangular raster over the screen 28. A plurality of neck components 44, comprising purity adjustment magnets and static convergence magnets, encircle the neck portion 18 in the vicinity of the electron gun 34.

An external magnetic shield 46, comprising a U-shaped strip of silicon steel, is attached to the outer surface of the envelope 14 by a suitable adhesive. Alternatively, the shield 46 may be attached to the implosion band (not shown) which encircles the tube near where the faceplate sidewall 24 is frit sealed to the funnel portion 20. The external shield 46 overlies the internal shield 32 and preferably overlies the mask frame assembly 30. A tilted "Z" axis type degaussing coil 48 is wrapped about the envelope 14 in such a fashion that when the coil 48 is activated, the lines of flux (not shown) degauss the external shield 46, as well as the internal shield 32 and the shadow mask frame assembly 30. While a tilted "Z" axis type degaussing coil is preferred, other types of degaussing coils, well known in the art, may also be used.

In the preferred embodiment of FIGS. 1–4, the external magnetic shield 46 is formed of 50 mm wide (2 inch), 0.46 mm (0.018 inch) thick silicon steel. The shield 46 is disposed along opposite sides of the funnel portion 20 and neck portion 18 of the tube 12 and extends across the longitudinal axis (Z) behind the neck portion 18 so as to shunt the external magnetic fields from the tube to minimize the effect of the magnetic fields on the electron beams. The distance that the external shield extends behind the neck portion 18 depends on the type of socket (not shown) which is attached to the base 40. As shown in FIG. 1, the external shield 46 is laterally spaced from the deflection yoke assembly 42 and from the neck components 44 a sufficient distance to permit final adjustment and securing of the yoke assembly 42 and adjustment of the neck components 44 after the attachment of the shield 46. The ease of access to the yoke assembly 42 and neck components 44 is further evident from FIG. 2.

Figure 2:
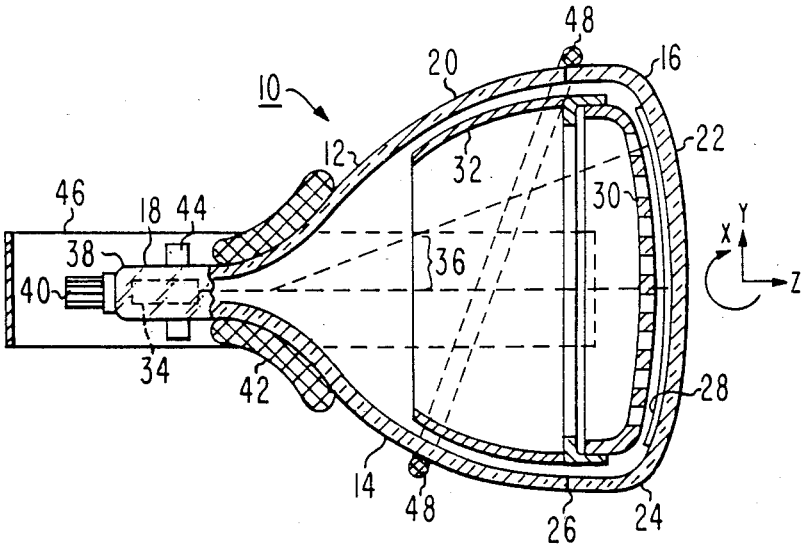
FIG. 2 is an axial view of the tube in FIG. 1 taken along lines 2—2.
Figure 3:
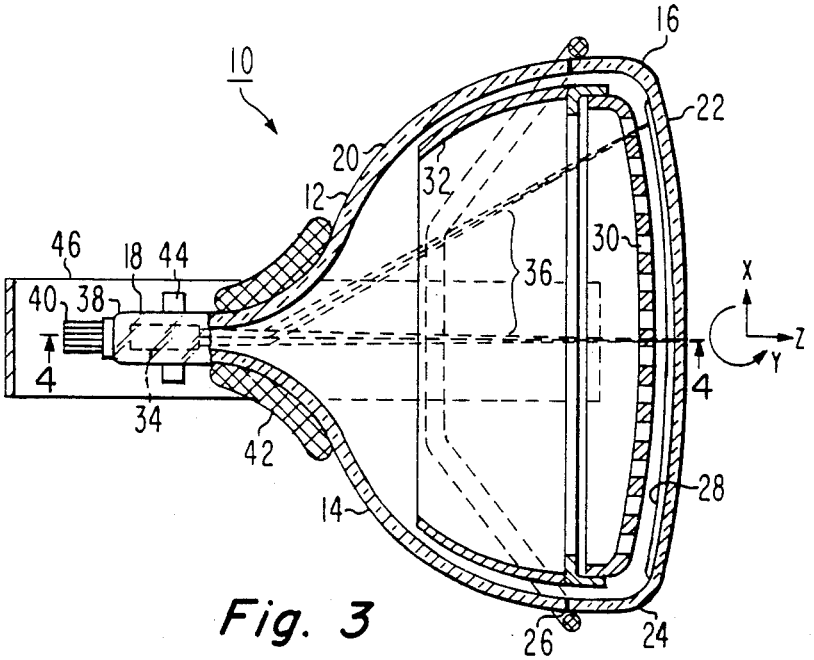
FIG. 3 is an axial view in horizontal section of a color image display system embodying the present invention which is disposed along the minor axis of a shadow mask type cathode-ray tube.
Figure 4:
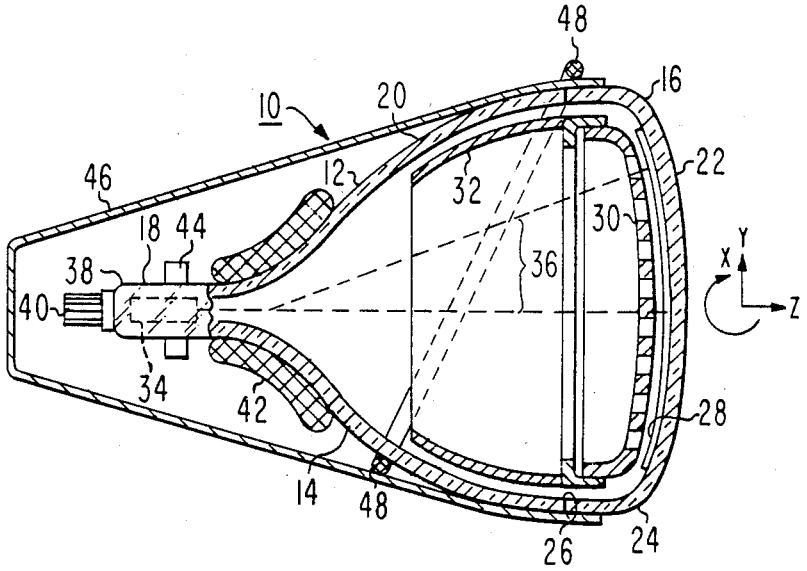
FIG. 4 is an axial view of the tube of FIG. 3 take along lines 4—4.
Figure 5:
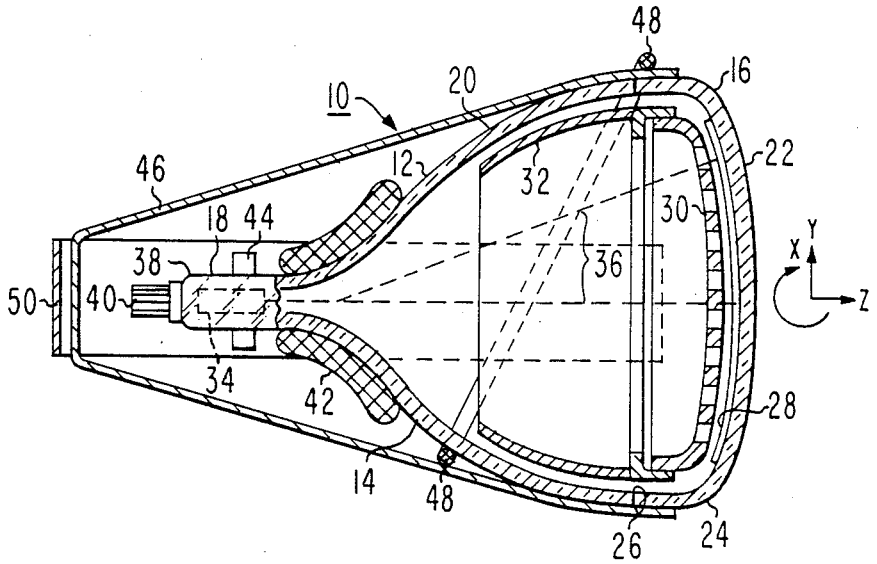
FIG. 5 is an axial view in vertical section of a color image display system showing another embodiment of the present invention disposed along both the major and minor axes of a shadow mask type cathode-ray tube.

The orientation of the external magnetic shield 46 depends upon the geographical location and operational orientation of the system 10. For example, if the system 10 is to be operated in a television receiver or display terminal so that the longitudinal tube axis (Z) is parallel to the horizontal component of the earth's magnetic field, then, in Singapore, for example, where the horizontal component of the earth's magnetic field is twice as great as in the United States, the external shield 46 should be aligned along the major axis (X) of the tube 14, as shown in FIGS. 1 and 2, to provide maximum magnetic shielding. However, if the same tube were operated for the same applications in the United States, where the vertical component of the earth's magnetic field is more than twice as great as the horizontal component, the external magnetic shield 46 should be aligned along the minor axis (Y) of the tube 14, as shown in FIGS. 3 and 4, in order to shunt the vertical component of the magnetic field around the tube. The system 10 may also be operated in a face-up mode, for example, in a video game table, so that the longitudinal tube axis (Z) is aligned parallel to the vertical component of the earth's magnetic field. In the face-up mode, the external magnetic shielding 46 shunts the vertical component of the earth's magnetic field; however, the orientation of the shielding 46 depends upon the direction of the horizontal component of the field and the rotational orientation of the tube 14 within the horizontal field. If the ultimate tube operating position is not known or if the tube is to be used in a geographical location where the magnetic intensity is substantially different from that experienced in the United States, a second external magnetic shield 50, such as that shown in FIG. 5, may be used. The second external shield 50 is similar to shield 46 in all respects except that its overall length is adjusted so that it does not touch shield 46. The second external shield 50 is attached to the tube envelope so that it is orthogonal to shield 46 where it is attached to the envelope.

The test results on a 25 inch diagonal, 110 degree tube indicate that an external shield 46 disposed, as shown in FIGS. 1 and 2, reduces the influence of the horizontal component of the earth's magnetic field along the longitudinal tube axis (Z) on beam register movement in the corners of screen by a factor of about 2 (from 32 $\mu$m to 15 $\mu$m) using a tilted "Z" degaussing coil 48 of 1000 ampere-turns. Thorough degaussing, using a hand-held coil (not shown), further reduces the beam register movement from about 18 $\mu$m to 8 $\mu$m. Locating the external shield 46, as shown in FIGS. 3 and 4, reduces the influence of the vertical component of the earth's magnetic field on beam register movement also by a factor of about 2 (from 65 μm to 35 μm) using the tilted "Z" degaussing coil 48 of 1000 ampere-turns. Thorough degaussing further reduces the beam register movement from about 34 μm to 8 μm. The above reduction in beam register movement is achieved by having the shield 46 extend behind the neck portion 18 and across the longitudinal axis (Z) of the tube 14 to shunt some of the magnetic field away from the beam paths.

What is claimed is:

1. In a color image display system including:

a color picture tube having an evacuated envelope comprising a panel portion enclosing a display screen, a neck portion and a funnel portion connecting said panel portion and said neck portion;

a shadow mask frame assembly disposed within said envelope in proximity to said display screen;

an internal magnetic shield interconnected to said shadow mask frame assembly;

an electron gun assembly, mounted along a longitudinal axis in said neck portion, for producing a plurality of electron beams;

a deflection yoke assembly encircling adjoining segments of said neck and funnel portions for developing deflection fields which permit scanning of a display raster on said screen; and a plurality of neck components disposed around said neck portion, the improvement comprising;

an external magnetic shield including at least one strap-like member having a substantially U-shaped configuration attached to said envelope, said shield being disposed along opposite sides of said funnel and neck portions and extending across said longitudinal axis behind said neck portion for shunting magnetic fields from said tube to minimize the effect of the magnetic fields on said electron beams, said shield being spaced from and external to said deflection yoke assembly and said neck portion, said shield being shaped to provide access to said deflection yoke assembly and said neck components to permit adjustment thereof without removing said shield.

2. The system as described in claim 1, wherein said external magnetic shield overlies at least a portion of said internal magnetic shield.

3. The system as described in claim 1, wherein said external magnetic shield overlies said mask frame assembly.

4. The system as described in claim 1, wherein said external magnetic shield is coupled to said internal magnetic shield and to said mask frame assembly.

5. The system as described in claim 1, wherein degaussing means are attached to said envelope.

6. In a color image display system including:

a color picture tube having a longitudinal axis, said tube including an evacuated envelope comprising a panel portion enclosing a display screen, a neck portion and a funnel portion connecting said panel portion to said neck portion, said panel portion having a major axis and a minor axis;

a shadow mask frame assembly disposed within said envelope in proximity to said display screen;

an internal magnetic shield interconnected to said shadow mask frame assembly;

an electron gun assembly, mounted along said longitudinal axis in said neck portion, for producing three inline electron beams;

a deflection yoke assembly encircling adjoining segments of said neck and funnel portions for developing orthogonal deflection fields which permit the beams to scan in the direction of the major axis and in the direction of the minor axis for producing a rectangular raster on said screen; and a plurality of neck components disposed around said neck portion for adjusting purity and static convergence, the improvement comprising;

an external magnetic shield including at least one strap-like member attached to an outside surface of said envelope, said strap-like member having a substantially U-shaped configuration and being disposed along opposite sides of said funnel and neck portions and extending across said longitudinal axis behind said neck portion for shunting magnetic fields from said tube to minimize the effects of the magnetic fields on said electron beams, said U-shaped strap-like member being aligned with one of said axes and being spaced from and external to said deflection yoke assembly and said neck portion, said member being shaped to provide access to said yoke assembly and to said neck components to permit adjustment thereof without removing said strap-like member.

7. The system as described in claim 6 further including a second strap-like member having a substantially U-shaped configuration orthogonally disposed with respect to said one strap-like member so as to be aligned with the other of said axes, said second strap-like member being attached to said outside surface of said envelope and extending along opposite sides of said funnel and neck portions and across said longitudinal axis behind said neck portion, said second strap-like member being spaced from said deflection yoke assembly and from said neck portion to provide access to said deflection yoke assembly and to said neck components.

8. The system as described in claim 7, wherein said strap-like members are spaced apart behind said neck portion to prevent contact therebetween.

9. The system as described in claim 8, wherein said strap-like members overlie at least a portion of said internal magnetic shield and said mask frame assembly to provide coupling thereto.

10. The system as described in claim 9, wherein degaussing means are attached to said envelope.

* * * * *